United States Patent [19]

Willigman

[11] Patent Number: 4,587,389

[45] Date of Patent: May 6, 1986

[54] SNAP ACTION TIMER SWITCH ASSEMBLY

[75] Inventor: John Willigman, Elk Grove Village, Ill.

[73] Assignee: Controls Company of America, Schiller Park, Ill.

[21] Appl. No.: 679,349

[22] Filed: Dec. 7, 1984

[51] Int. Cl.[4] ..... H01H 19/56; H01H 43/10

[52] U.S. Cl. ..... 200/153 LB; 200/283; 200/27 B; 200/38 B

[58] Field of Search ..... 200/68.1, 153 LB, 283, 200/27 R, 27 B, 38 R, 38 B, 38 BA, 38 C; 74/560 T

[56] References Cited

U.S. PATENT DOCUMENTS

| | | | |
|---|---|---|---|
| Re. 29,158 | 3/1977 | Cartier et al. | 200/38 B |
| 3,390,293 | 6/1968 | Obermann | 200/283 |
| 4,366,352 | 12/1982 | Obermann | 200/35 R |
| 4,381,432 | 4/1983 | Cushing | 200/38 B |
| 4,413,164 | 11/1983 | Obermann et al. | 200/38 R |
| 4,525,608 | 6/1985 | Cushing | 200/38 R |
| 4,531,028 | 7/1985 | Stout et al. | 200/38 R |

*Primary Examiner*—Stephen Marcus
*Assistant Examiner*—Ernest G. Cusick
*Attorney, Agent, or Firm*—David L. Davis; Robert E. Smith; Edward L. Bell

[57] ABSTRACT

A switch assembly to provide snap action switching on a cam rise in a program timer includes a follower assembly on the free end of a first blade to engage the program member to reference the first blade relative to the program member. A cam follower for actuating a second blade has a relatively high coefficient of friction between it and the follower assembly so that when a steep cam rise is encountered the horizontal force from the cam rise forces the cam follower tightly against the follower assembly, to lock the cam follower to the follower assembly. At the end of the cam rise, the horizontal force is released and the snap action occurs.

6 Claims, 20 Drawing Figures

SNAP ACTION TIMER SWITCH ASSEMBLY

DESCRIPTION

Background of the Invention

This invention relates to program timers and, more particularly, to a switch assembly for use with a program timer to provide snap action switching.

Conventional program timers typically include a program drum which is molded to provide a multiplicity of timing cams contoured to actuate switches in sequence as the drum rotates. U.S. Pat. No. Re. 29,158 discloses a switch assembly for such a timer including upper and lower passive blades and an active blade therebetween. The distal end of the lower passive blade has depending spacers which straddle the cam upon which the follower on the distal end of the active blade rides. The spacers reference the lower passive blade off the hub of the drum type program cam. With precision molding, the switch assembly is accurately referenced from the cam hub. Although this arrangement is entirely satisfactory for its intended purpose, under certain circumstances it is desirable to obtain a fast, or snap, action break or make on a cam rise. It is therefore a primary object of the present invention to provide a switch assembly for use in a program timer which will have a snap action break or make on a cam rise.

SUMMARY OF THE INVENTION

The foregoing and additional objects are attained in accordance with the principles of this invention by providing a switch assembly for use with a timer having a program member including a moving cam track, the switch assembly comprising at least two blades, each having a free end biased toward the program member, a first follower on the free end of a first of the blades engaging the program member to reference the first blade relative to the program member, a cam follower engaging the cam track and actuating the free end of the second of the blades relative to the first blade, and guide means on the first follower for guiding the relative movement of the cam follower with respect to the first follower along a path substantially perpendicular to the cam track when substantially no lateral force is exerted on the cam follower and for constraining the first follower and the cam follower to move together when a lateral force above a predetermined threshold is exerted on the cam follower.

BRIEF DESCRIPTION OF THE DRAWINGS

The foregoing will be more readily apparent upon reading the following description in conjunction with the drawings in which like elements in different figures thereof have the same reference character applied thereto and wherein.

DETAILED DESCRIPTION

Figure 1:
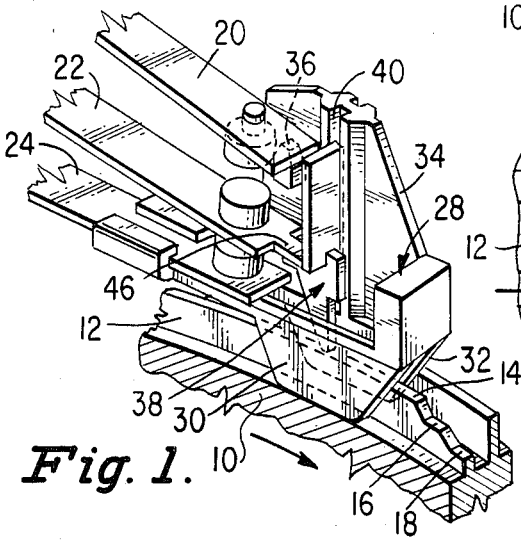
FIG. 1 is a perspective view of a first embodiment of a switch assembly constructed in accordance with the principles of this invention.
Figure 2:
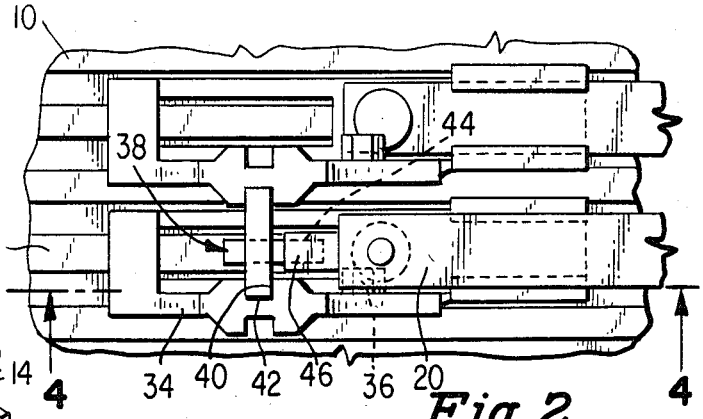
FIG. 2 is a top view of the embodiment shown in FIG. 1 also showing a portion of an adjacent switch assembly.

Referring now to the drawings, FIGS. 1, 2, 3 and 4A–4G illustrate a first embodiment of a switch assembly according to the present invention. This switch assembly is a modification of the assembly disclosed in U.S. Pat. No. Re. 29,158, the contents of which are hereby incorporated by reference. The program cam drum 10 located between the timer end plates for rotation in the direction shown by the arrow in FIG. 1. The cam track designated 12 has a maximum elevation portion 14, a mid portion 16, and a low portion 18. The switch assembly actuated by the cam track 12 has three switch blades 20, 22 and 24 having their proximal ends embedded in wafers 26, as disclosed in the referenced patent. As is conventional and disclosed in the referenced patent, the free ends of the blades 20, 22, and 24 each have a switch contact thereon. At the distal end of the blade 24, a molded follower assembly 28 is provided. This assembly includes a pair of depending spacers 30 and 32 which ride on the hub, or inter-cam track space, of the cam drum 10 so as to straddle the cam track 12 against which the switch assembly is self-biased. The molded follower assembly 28 thereby references the blade 24 relative to the program cam drum 10. The assembly 28 also includes an electrical barrier 34 projecting upwardly at one side of the assembly to increase the effective spacing between adjacent switch assemblies to minimize arcing between adjacent switches. The assembly also includes a stop 36 which limits downward travel of the blade 20.

In accordance with the principles of this invention, a cam follower 38 is provided. The electrical barrier 34 includes guide means in the form of a channel 40 formed thereon substantially perpendicular to the cam track 12. The channel 40 is for the purpose of guiding the relative movement of the cam follower 38 with respect to the follower assembly 28 along a path substantially perpendicular to the cam track 12. Thus, the cam follower 38 is formed with a portion 42 which is shaped to move longitudinally within the channel 40. The channel 40 is dimensioned to provide clearance between the cam follower 38 and the channel walls to allow free longitudinal movement of the cam follower 38 when substantially no lateral force is exerted on the cam follower 38. It is noted that the barrier 34 is formed with a channel 40 on either side thereof. Thus, a follower 38 is guided by channels 40 on adjacent follower assemblies 28, as is clearly shown in FIG. 2. The cam follower 38 is further formed with a ledge portion 44 which functions to actuate the free end 46 of the blade 22. Lastly, the cam follower 38 has a foot 48 which rides on the cam track 12. In accordance with this invention, the materials for the cam follower 38 and the follower assembly 28 are chosen so that there is a high coefficient of friction between the follower 38 and the walls of the channel 40. Illustratively, the follower 38 is formed of nylon or celcon material and the follower assembly 28 is formed of glass-filled nylon material.

The operation of the aforedescribed assembly will now be explained with reference to FIGS. 4A–4G. In the position shown in FIG. 4A, the blade 24 lightly biases the assembly 28 against the hub of the drum 10 and the blade 22, resting on the ledge 44, biases the cam follower 38 against the low portion 18 of the cam track 12. The dimensions of the elements are such that contact is made between the blades 22 and 24. As the cam drum 10 rotates, it reaches the position shown in FIG. 4B wherein the cam follower 38 comes up aganst a steep rise on the cam track 12 between the low portion 18 and the portion 16. This causes a lateral force to be exerted on the cam follower 38 which forces the cam follower 38 tightly against the walls of the channel 40. If the cam rise is sufficiently steep that the lateral force exerted on the cam follower 38 is above a threshold so that, due to the high coefficient of friction between the cam follower 38 and the follower assembly 28, the spring force of the blade 24 is insufficient to overcome the frictional force between the cam follower 38 and the follower assembly 28, these two elements are locked together. The predetermined threshold of the lateral force exerted on the cam follower 38 to lock the cam follower 38 to the follower assembly 28 is a function of the coefficient of friction between these two elements and the biasing force supplied by the blade 24. Thus, as the cam follower 38 ascends the steep rise, the follower assembly 28 is forced to do likewise, maintaining the relative positions of the blades 20, 22 and 24. When the cam drum 10 rotates to the position shown in FIG. 4C, the cam follower 38 is on the mid portion 16 of the cam track 12 and the lateral force previously exerted thereon during the cam rise is suddenly removed. The biasing force of the blade 24 then causes the assembly 28 to drop down from the follower 38, thereby causing a snap action break of the connection between the blades 22 and 24.

As the cam drum 10 continues to rotate to the position shown in FIG. 4D, the follower 38 again comes up against a steep cam rise, this time from the mid portion 16 to the maximum elevated portion 14 of the cam track 12. The cam follower 38 again has a strong lateral force exerted thereon, causing the cam follower 38 and the follower assembly 28 to be locked together. Thus, both the follower 38 and the assembly 28 rise together, maintaining the relative spacings between the blades 20, 22 and 24. When the cam drum 10 rotates sufficiently that the cam follower 38 is on the maximum elevated portion 14, as shown in FIG. 4E, the lateral force exerted on the cam follower 38 is suddenly removed, freeing the follower assembly 28 so that it drops down to the hub of the cam drum 10. When this occurs, this creates a snap action make between the blades 20 and 22.

Figure 4A:
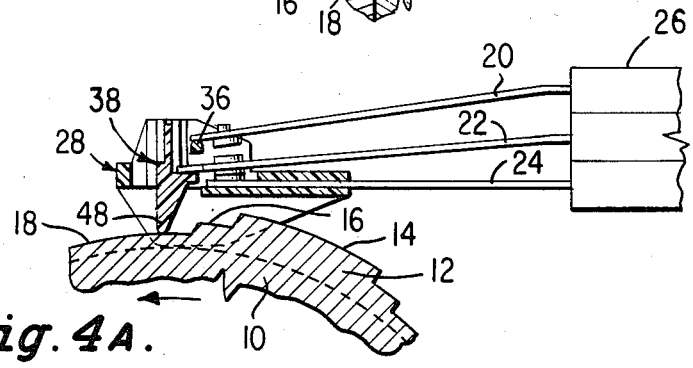
FIGS. 4A–4G are views taken substantially along the line 4—4 in FIG. 2 illustrating the switching sequence for the switch assembly shown in FIG. 1.
Figure 3:
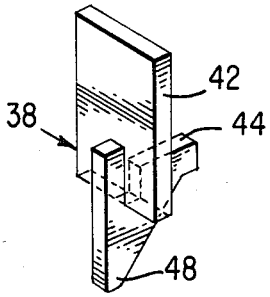
FIG. 3 is a perspective view of the cam follower of the embodiment shown in FIG. 1.
Figure 4B:
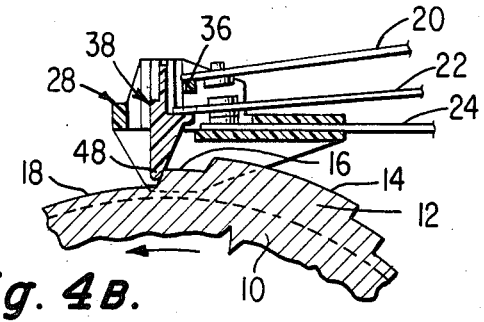
Figure 4C:
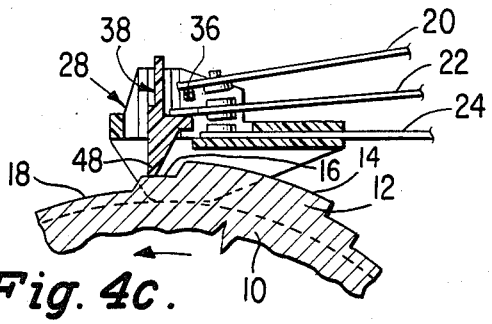
Figure 4D:
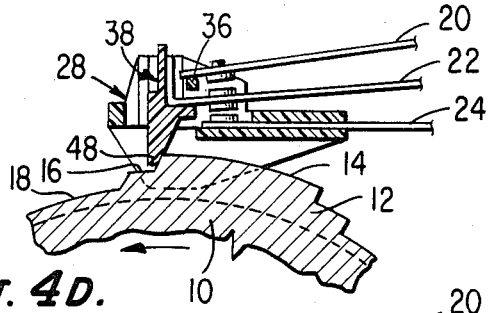
Figure 4E:
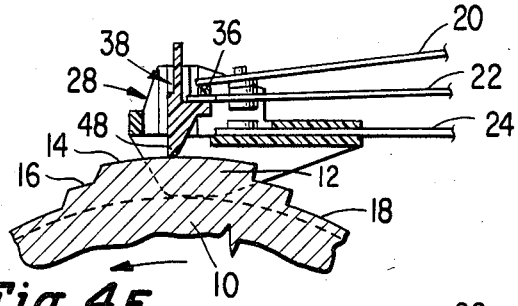
Figure 4F:
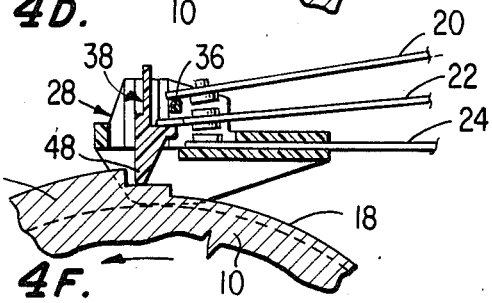
Figure 4G:
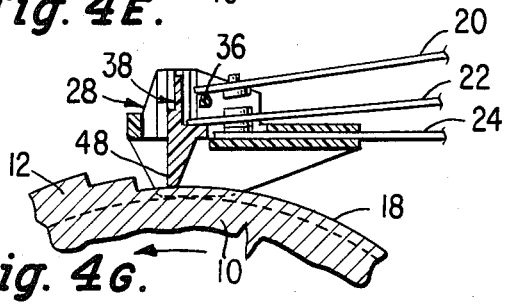
Figure 5:
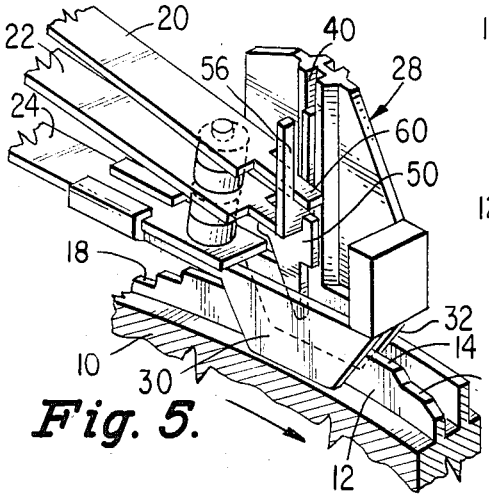
FIG. 5 is a perspective view of a second embodiment of a switch assembly constructed in accordance with the principles of this invention.
Figure 6:
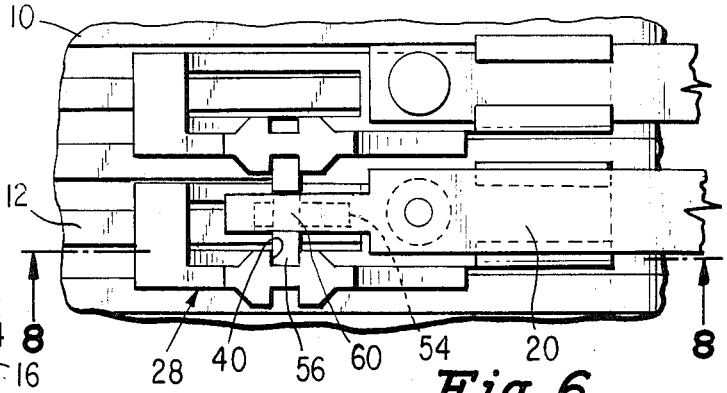
FIG. 6 is a top view of the embodiment shown in FIG. 5 also showing a portion of an adjacent switch assembly.

When the cam drum 10 rotates from the position shown in FIG. 4E to that shown in FIG. 4F, the follower 38 can drop suddenly from the maximum elevated portion 14 to the mid portion 16 of the cam track 12, creating a snap action break between the blades 20 and 22. Similarly, as the drum 10 rotates to the position shown in FIG. 4G, the cam follower 38 drops suddenly to the low portion 18 of the cam track 12, creating a snap action make between the blades 22 and 24.

Although single steps have been illustrated, it is apparent that if the switch assembly were to go from the condition shown in FIG. 4A directly to the condition shown in FIG. 4E, there would be a snap action break between the blades 22 and 24 followed almost immediately thereafter by a snap action make between the blades 20 and 22. Similarly, when going from the condition shown in FIG. 4E directly to the condition shown in FIG. 4G, there would be a snap action break between the blades 20 and 22 followed almost immediately thereafter by a snap action make between the blades 22 and 24.

It should be noted that, if instead of the conditions described above, if the blade 24 was heavily biased downwardly and there were a low coefficient of friction between the cam follower 38 and the assembly 28, and further if the cam rise were gentle rather than steep, the action of making or breaking switch contacts would occur in a more normal or expected fashion. However, the action on a cam drop would remain the same.

FIGS. 5, 6, 7 and 8A–8G depict a variation of the assembly shown in FIGS. 1, 2, 3 and 4A–4G. In this second embodiment, the follower assembly 28 is formed the same as in the first embodiment, except for the removal of the stop 36. The function of the stop 36 is provided by the differently configured cam follower 50. The cam follower 50 includes a foot 52 which rides on the cam track 12, a ledge 54 for actuating the blade 22 and a portion 56 which rides in the channel 40. Additionaly, the portion 56 is cut out to provide a shelf 58 for supporting the tongue 60 formed at the distal end of the blade 20.

Figure 8A:
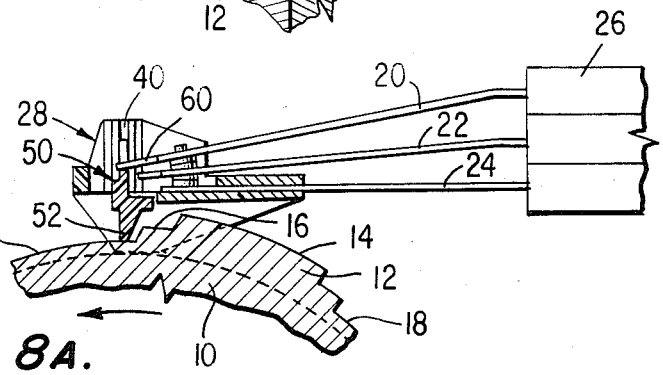
FIGS. 8A–8G are views taken substantially along the line 8—8 in FIG. 6 illustrating the switching sequence for the switch assembly shown in FIG. 5.
Figure 7:
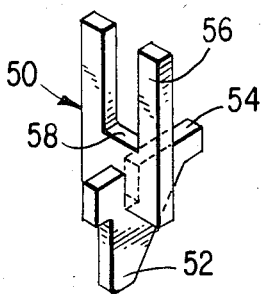
FIG. 7 is a perspective view of the cam follower of the embodiment shown in FIG. 5.
Figure 8B:
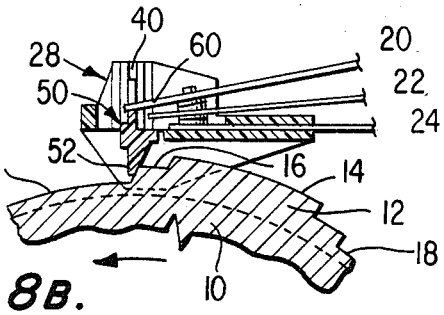
Figure 8C:
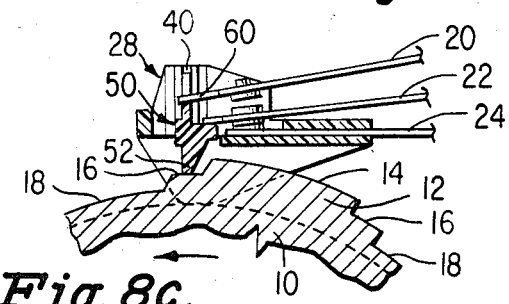
Figure 8D:
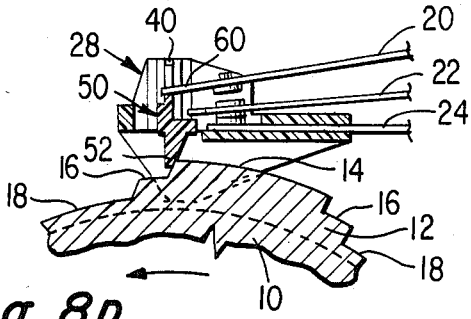
Figure 8E:
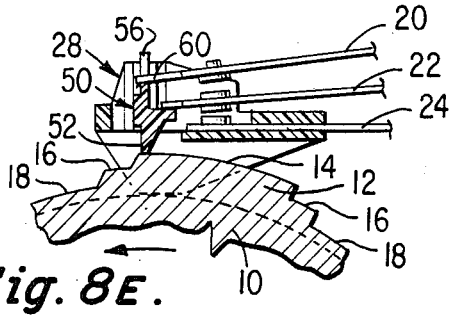

Referring now to FIG. 8A, with the switch assembly at the low portion 18 of the cam track 12, the condition of the switches is such that contact is made between all of the switch blades 20, 22 and 24. As shown in FIG. 8B, when the cam follower 50 goes up against a steep rise of the cam track 12, a lateral force is exerted against the cam follower 50 to lock the cam follower 50 in the channel 40 so that the cam follower 50, the follower assembly 28, and the switch blades 20, 22 and 24 all rise in unison. As shown in FIG. 8C, when the cam follower 50 reaches the mid portion 16 of the cam track 12, the lateral force exerted thereon suddenly disappears, allowing the follower assembly 28 to drop under the biasing force of the blades 22 and 24, resulting in a snap action break between the blades 20 and 22. As shown in FIG. 8D, when the next steep cam rise is encountered, the cam follower 50, follower assembly 28 and the blades 20, 22 and 24 again rise in unison. When the cam follower 50 reaches the maximum elevation portion 14 of the cam track 12, the lateral force exerted on the cam follower 50 is removed and the follower assembly 28, under the biasing force of the blade 24, drops. However, the blade 22 is prevented from moving downward by the ledge 54 of the cam follower 50, creating a snap action break between the contacts 22 and 24.

Figure 8F:
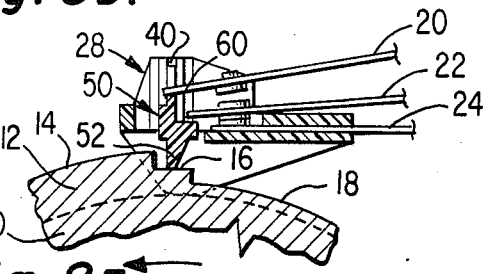
Figure 8G:
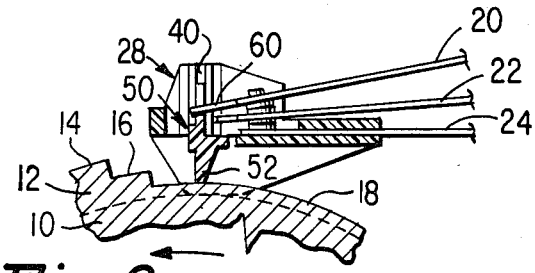

As shown in FIG. 8F, when the cam follower 50 drops from the maximum elevation portion 14 to the mid portion 16 of the cam track 12, a snap action make between the blades 22 and 24 results. Similarly, as shown in FIG. 8G, when the cam follower 50 drops to the low portion 18 of the cam track 12, a snap action make between the blades 20 and 22 results.

It is apparent that if the cam follower 50 encounters a steep rise from the low portion 18 to the maximum elevation portion 14 of the cam track 12, there will be an almost simultaneous snap action break of the connections between the blades 20 and 22 and between the blades 22 and 24, with the break between the blades 20 and 22 occurring slightly ahead of the break between the blades 22 and 24. Similarly, if the cam follower 50 were to drop from the maximum elevation portion 14 to the low portion 18 of the cam track 12, there would be an almost simultaneous snap action make between the blades 20 and 22 and the blades 22 and 24 with the make between the blades 22 and 24 occurring first.

As with the first embodiment, if the blade 24 were to heavily bias the follower assembly 28 and there were a low coefficient of friction between the cam follower 50 and the follower assembly 28, and further if there were a gentle rather than steep rise on the cam track 12, the contact breaking action would be slow, as opposed to snap.

Accordingly, there have been disclosed embodiments of a switch assembly for use with a program timer to provide snap action switching. It is understood that the above-described embodiments are merely illustrative of the application of the principles of this invention. Numerous other embodiments may be devised by those skilled in the art without departing from the spirit and scope of this invention, as defined by the appended claims.

I claim:

1. A switch assembly for use with a timer having a program member including a moving cam track, said switch assembly comprising:

at least two blades, each having a free end with a respective switch contact thereon and self-spring biased toward the program member;

a first follower on the free end of a first of said blades engaging the program member to reference the first blade relative to the program member;

a cam follower engaging said cam track and actuating the free end of the second of said blades relative to said first blade; and guide means on said first follower arranged to selectively frictionally engage said cam follower for guiding said cam follower with respect to said first follower for movement along a path substantially perpendicular to said cam track when substantially no lateral force is exerted on said cam follower and a consequent low friction force exists between said first follower and said cam follower and for constraining said first follower and said cam follower to move together when a lateral force above a predetermined threshold is exerted on said cam follower to generate a frictional force between said first follower and said cam follower which is greater than the self-spring bias force of said first blade.

2. The assembly according to claim 1 wherein said guide means includes a channel formed on said first follower and said cam follower includes a portion adapted to move longitudinally in said channel, said channel being dimensioned to provide clearance between said cam follower portion and the channel walls to allow free longitudinal movement of said cam follower when substantially no lateral force is exerted on said cam follower.

3. The assembly according to claim 2 wherein said guide means is further constituted by a second channel formed on the first follower of an adjacent similarly configured switch assembly and said cam follower includes a second portion adapted to move longitudinally in said second channel.

4. The assembly according to claim 2 wherein said cam follower portion and said channel walls are formed of materials having a relatively high coefficient or friction with respect to each other so that when a lateral force above said predetermined threshold is exerted on said cam follower to force said cam follower portion into contact with a channel wall said first follower and said cam follower are constrained to move together in the longitudinal direction.

5. The assembly according to claim 4 further including a third blade having a free end with a respective switch contact thereon and self-spring biased toward the program member, said third blade being positioned between said first and second blades, said cam follower including an actuator portion adapted to engage said third blade free end and move said third blade away from said program member after said cam follower has moved sufficiently away from said program member that said second blade has been moved away from said program member while maintaining a minimum spacing between said second and third blades.

6. The assembly according to claim 4 further including a third blade having a free end with a respective switch contact thereon and self-spring biased toward the program member, said third blade being positioned outwardly of said first and second blades relative to said program member, said first follower including means engaging said third blade free end for referencing said third blade relative to said first blade.

* * * * *